United States Patent [19]

Houghton et al.

[11] 4,011,823

[45] Mar. 15, 1977

[54] TUFTING TOOL FOR EVEN STITCHING

[75] Inventors: George L. Houghton, Santa Ana; Fred F. Fredensberg, Long Beach, both of Calif.

[73] Assignee: Rug Crafters, Santa Ana, Calif.

[22] Filed: Jan. 30, 1976

[21] Appl. No.: 653,926

[52] U.S. Cl. ..... 112/80

[51] Int. Cl.[2] ..... D05C 15/06

[58] Field of Search ..... 112/80, 79 R, 79.5, 112/78, 222, 223, 227

[56] References Cited

UNITED STATES PATENTS

| | | | |
|---|---|---|---|
| 1,452,544 | 4/1923 | Baker | 112/80 |
| 1,557,970 | 10/1925 | Borrows et al. | 112/80 |
| 2,753,820 | 7/1956 | Lustig | 112/80 |
| 3,714,915 | 2/1973 | Montell et al. | 112/80 |

*Primary Examiner*—H. Hampton Hunter
*Attorney, Agent, or Firm*—Gordon L. Peterson

[57] ABSTRACT

A tufting tool comprising an elongated body, a shuttle mounted on the body for reciprocating movement, an elongated resilient plunger attached to the shuttle, and a needle mounted on the body and having a yarn receiving passage and a plunger receiving passage. The needle includes a first portion attached to the body and a penetrating portion projecting from the first portion and terminating in a relatively sharp point remote from the first portion. The penetrating portion and the resilient plunger are adapted for insertion into and withdrawal from a backing material. The penetrating portion includes a cam for resiliently loading the plunger so that upon complete withdrawal of the penetrating portion from the backing material, the plunger resiliently removes the needle forward relative to the plunger so that the needle can advance along the backing material.

11 Claims, 9 Drawing Figures

Fig. 1
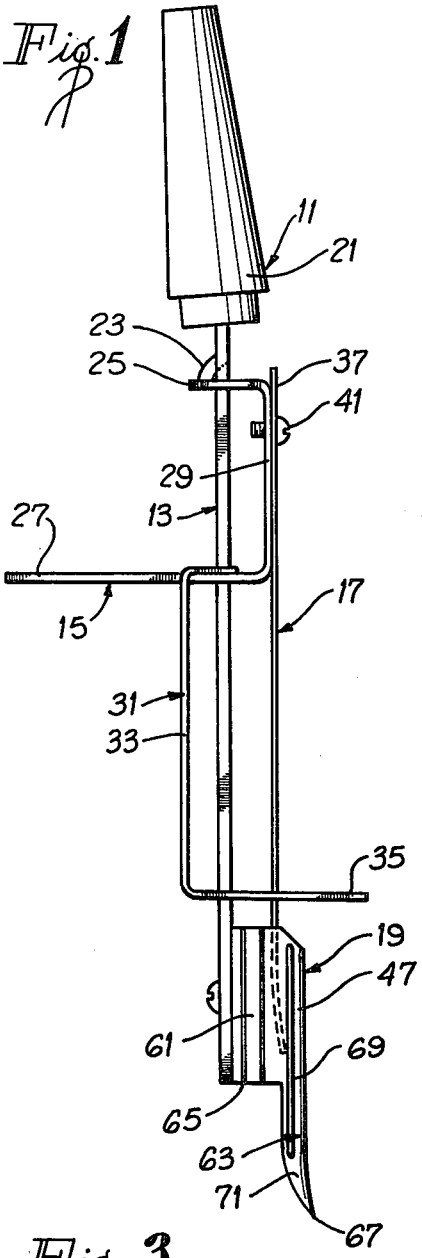
Fig. 2
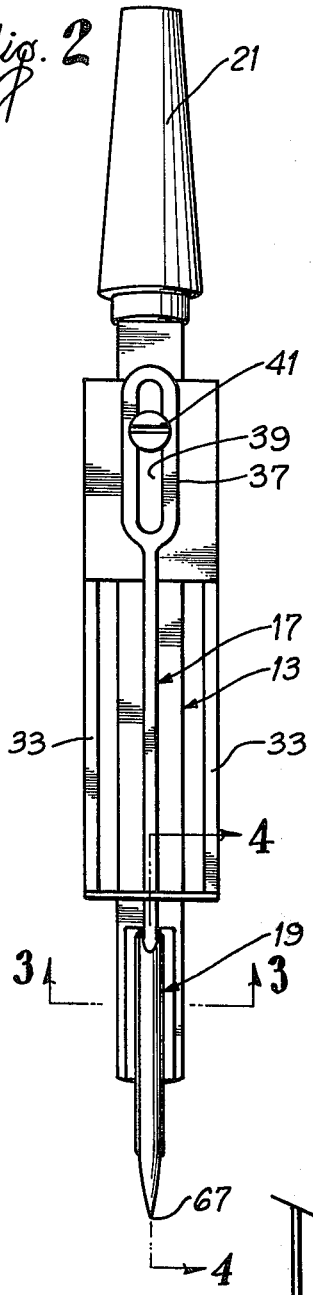
Fig. 3
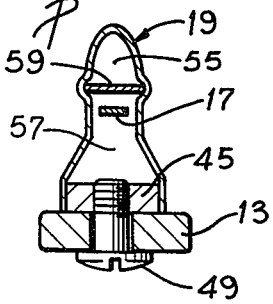
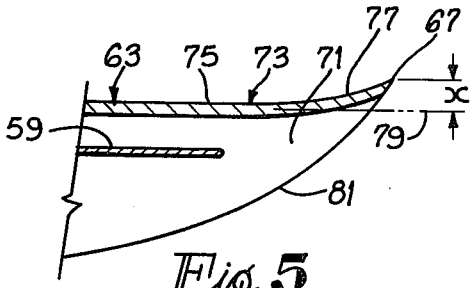
Fig. 5
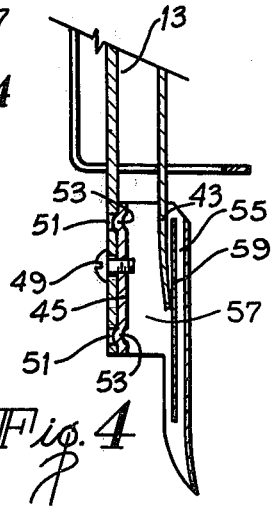
Fig. 4

Fig. 6
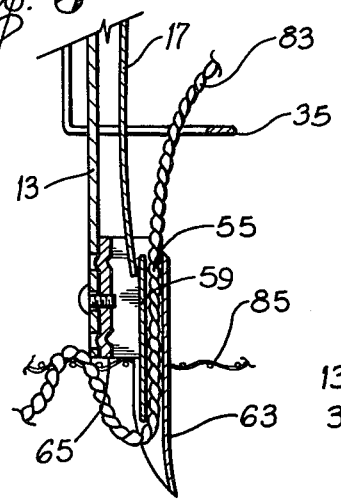
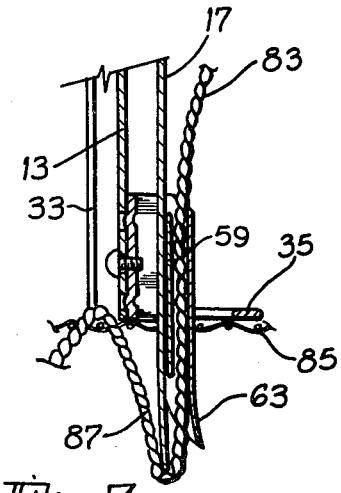
Fig. 7
Fig. 8
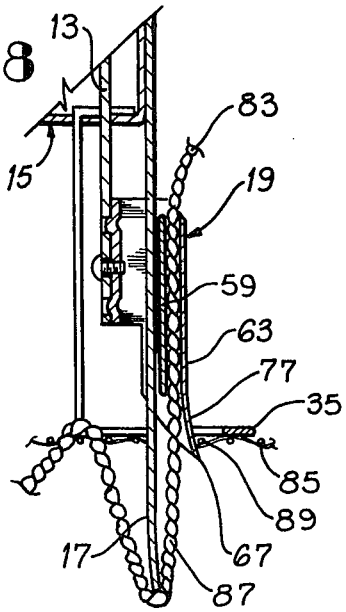
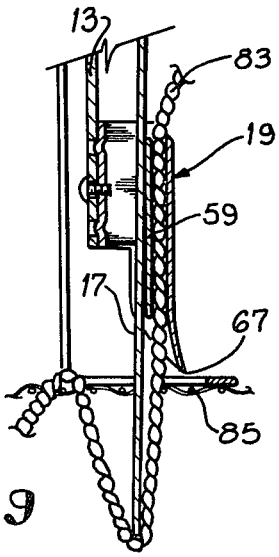
Fig. 9

TUFTING TOOL FOR EVEN STITCHING

BACKGROUND OF THE INVENTION

Tufting is a process for making rugs, wall hangings and other items from yarn. Tufting is characteristically carried out by the home craftsman using a hand-operated tufting tool.

One of the most popular tufting tools is shown in common assignee's U.S. Pat. No. 3,714,915. This tufting tool includes an elongated body and a shuttle mounted on the body for reciprocating movement relative to the body. An elongated resilient plunger is attached to the shuttle for movement with the shuttle. A needle is mounted on the body adjacent one end of the body. The needle has a yarn receiving passage and a plunger receiving passage with the plunger receiving passage being adapted to receive at least a portion of the plunger. The needle includes a first portion attached to the body and a penetrating portion projecting from the first portion and terminating in a relatively sharp point remote from the first portion. The yarn receiving passage extends through the first portion and the penetrating portion.

In use of this prior art tufting tool, yarn is threaded through the yarn receiving passage and the needle and plunger are forced through a first location on a backing material. This forces one loop of the yarn through the backing material. The needle is then withdrawn from the backing material leaving the plunger in the backing material. Following this the needle is forced through a second location on the backing material and the shuttle is reciprocated to remove the plunger from the first location to the second location. This process is repeated to form a number of yarn loops on the backing material with one of the loops being initiated each time the needle is inserted into the backing material.

This tufting tool works very well. Although use of this tufting tool can be learned relatively quickly, the inexperienced operator may have some difficulty in getting each of the stitches to be of even length. The stitch length is dependent on the forward travel of the needle between adjacent insertions of the needle of the backing material.

For many applications it is desired to have about five or six even stitches per inch. Those who are inexperienced in the art of tufting tend to stitch unevenly and frequently beginners make too many stitches per inch. This makes the height of the pile uneven and significantly detracts from the appearance of the tufted article. In addition, too many stitches wastes yarn.

SUMMARY OF THE INVENTION

The present invention solves this problem by providing a tufting tool in which stitch length is more easily controlled even by an inexperienced operator. The tufting tool of this invention provides some degree of automatic control over stitch length, and to this extent makes it easier for the inexperienced craftsman to provide stitches of even length.

This can be advantageously accomplished by providing cam means according to this invention on the penetrating portion of the needle. The cam means cooperates with the backing material as the penetrating portion is withdrawn from the backing material with the plunger remaining in the backing material to resiliently load the plunger. With the plunger resiliently loaded, upon complete withdrawal of the penetrating portion from the backing material, the energy stored in the plunger moves the needle forward relative to the plunger to advance the needle along the backing material. Thus, an automatic advancing motion of the needle is provided as soon as the needle is withdrawn from the backing material. With the cam means of this invention, this advancing motion of the needle is substantially the same each time the tufting tool is operated and so it is much less likely that even an inexperienced operator will obtain stitches of an uneven length.

The prior art tufting tool shown in common assignee's U.S. Pat. No. 3,714,915 tends to cause the needle to "walk" across the backing material, and this is due, at least in part, to the curved resilient end portion of the plunger. However, the steps provided by the prior art tufting tools when used by inexperienced operators tend to provide much greater variation in stitch length than when the cam means of the present invention is used. This is due, at least in part, to the fact that the steps taken by the prior art tool across the backing material are smaller than the steps provided for by the present invention. Accordingly, a step error of a given length will produce a much greater percentage error. Also, with the prior art tool the operator must exert some significant degree of control over the walking movement of the tool to obtain the desired five to six stitches per inch.

In order to provide the predictability and stitch length desired, the cam means should have a throw of at least about 0.020 inch. A cam throw of greater than 0.050 inch is not ordinarily desirable because the weave of conventionally used backing materials has difficulty in accepting a cam means with this length of throw. In addition, the stitch length for many projects would be too long if cam throws exceeding 0.050 inch were utilized.

Generally, the greater the cam throw the greater the length of stitch. For most tufting operations, the preferred range of cam throws is from about 0.030 inch to about 0.040 inch as this tends to automatically provide the desired five to six stitches per inch.

The cam means can be advantageously provided on the penetrating portion of the needle by inclining the end section of the needle radially outwardly of the body as the end section extends toward the point. The incline should be sufficient to displace the point a distance equal to the desired cam throw from the position the point would occupy if the end section were not inclined, i.e. if it extended axially. The cam means of this invention can be provided in addition to any other means contained in prior art tufting tools for walking the needle along the backing material.

Except for the cam means for controlling stitch length, the tufting tool of this invention may, if desired, be identical to the tufting tool shown in common assignee's U.S. Pat. No. 3,714,915. Some prior art tufting tools made in accordance with this patent have the end section of the needle bent slightly radially outwardly an amount which may be of the order of 0.003 inch to 0.004 inch. This was the result of the method of manufacturing employed and is insufficient to provide any more than a negligible camming action and these tools do not produce the results obtained by this invention.

The invention, together with further features and advantages thereof, can best be understood by reference to the following description taken in connection with the accompanying illustrative drawing.

BRIEF DESCRIPTION OF THE DRAWINGS

FIG. 1 is a side elevational view of a tufting tool constructed in accordance with the teachings of this invention.

FIG. 2 is a top plan view of the tufting tool.

FIG. 3 is a sectional view taken generally along line 3—3 of FIG. 2.

FIG. 4 is a sectional view taken generally along line 4—4 of FIG. 2.

FIG. 5 is an enlarged fragmentary sectional view of a portion of the penetrating portion of the needle.

FIGS. 6–9 are fragmentary, axial sectional views showing the sequence of operation of the tufting tool.

DESCRIPTION OF THE PREFERRED EMBODIMENT

FIGS. 1 and 2 show a tufting tool 11 which includes an elongated body 13, a shuttle 15 mounted on the body for reciprocating movement relative thereto, an elongated resilient plunger 17 attached to the shuttle for movement with the shuttle, and a needle 19 attached to the body. In the embodiment illustrated, the body 13 is in the form of an elongated metal bar of rectangular cross sectional configuration. A handle 21 of wood or other suitable material is mounted at one end of the handle. A stop 23 for the shuttle 15 is formed integrally with the body 13. The body 13 is rigid, flat, and its axis extends linearly.

The shuttle 15 is preferably constructed of metal and may include a short leg 25 and a long leg 27 integrally joined by a web 29. Each of the legs 25 and 27 has an opening for slidably receiving the body 13, and the leg 27 is sufficiently long to facilitate manual gripping thereof. The web 29 is spaced from the shank and generally parallel thereto.

A wire hoop 31 is suitably rigidly affixed to the leg 27 and is movable with the shuttle 15. The hoop 31 includes arm sections 33 and a U or channel section 35 integrally joined to the arm sections.

The plunger 17 is an elongated thin member preferably constructed of spring steel so as to be resilient. The plunger 17 has a mounting portion 37 which includes a slot 39. A fastener such as a screw 41 extends through the slot 39 and into a threaded opening in the web 29 to thereby adjustably mount the plunger 17 on the shuttle 15. The axial position of the plunger 17 relative to the shuttle 15 can be adjusted by loosening the screw 41 and moving the plunger axially as permitted by the slot 39. As shown in FIG. 4, the plunger 17 has an end portion 43 which curves radially away from the body 13 as it extends toward the tip of the plunger.

The needle 19 is mounted at the end of the body 13 remote from the handle 21. In the embodiment illustrated, the needle includes a base 45 and an integral housing section 47 attached to the base. The needle 19 is constructed of metal, although other materials could be used. Although the needle 19 can be mounted on the body 13 in different ways, in the embodiment illustrated, this is accomplished by a screw 49 (FIG. 4) which extends through the body 13 and into the base 45. The correct angular position of the housing 19 relative to the body 13 is established by locator means which comprises a pair of apertures 51 in the body 13 and corresponding integral projections 53 formed in the base.

The base 45 and the housing section 47 define a hollow housing which is divided into a yarn receiving passage 55 and a plunger receiving passage 57 by a plate strip 59 which is suitably carried by the housing section 47. Viewed from another perspective, the needle 19 includes a base section or first portion 61 (FIG. 1) and a penetrating portion 63. The first portion terminates in an end face 65 which, in the embodiment illustrated, is substantially flush with the end of the body 13. The plunger receiving passage 57 extends through the first portion.

The penetrating portion 63 extends generally axially outwardly of the end face 65 of the first portion 61 and terminates in a point 67. The yarn receiving passage 55 extends through both the first portion 61 and the penetrating portion 63.

The penetrating portion 63 includes a straight section 69 which extends axially of the body 13 and an end section 71 integrally joined to the straight section and extending axially and radially of the body 13. The end section 71 is inclined relative to the straight section 69 so that the point 67 is displaced radially of the body 13 at least about .020 inch from the position it would occupy if the end section 71 were not inclined relative to the straight section, i.e. if the end section formed a purely axial continuation of the straight section 69.

The construction of the end section 71 can also be understood by reference to FIG. 5 which shows that the penentrating portion 63 has an exterior edge surface 73 having a first section 75 which is relatively flat and which extends axially of, and parallel to, the body 13 and a second section 77 which extends axially and radially of the body 13. Specifically, the second section 77 in the embodiment illustrated is curved radially outwardly away from the body 13 as it extends toward the point 67.

The result of this construction is to radially displace the point 67 a distance X (FIG. 3) from a reference line 79 which forms an axial extension of the first section 75. The second section 77 constitutes a cam surface and the X dimension is the throw of the cam. As indicated hereinabove, the X dimension may be from about 0.020 inch to about 0.050 inch with the range of 0.030 to 0.040 inch being preferred.

The second section 77 may curve or be relatively straight. The incline of the second section 77 may be brought about by bending of the metal of the penetrating portion 63 or in other ways. If desired, the full length of the penetrating portion 63 may be inclined to provide the desired X dimension.

The penetrating portion 63 also has a second exterior edge surface 81 lying radially intermediate the exterior edge surface 73 and the body 13. The edge surface 81 has a curved inclined section which is inclined in the same direction as the second section 77 and which terminates at the point 67.

The operation of the tufting tool 11 can best be understood by reference to FIGS. 6–9. Yarn 83 is threaded through the yarn receiving passage 55 as shown in FIG. 6 and the penetrating portion 63 is forced through a backing material 85. The backing material 83 may be any material commonly used for that purpose and may be, for example, jute. Also as shown in FIG. 6, the plunger 17 is in a retracted position and the end face 65 rests flat against the backing material 85.

Next, the shuttle 15 is pushed downwardly along the body 13 until the U-section 35 of the hoop 31 strikes the backing material 85. This advances the plunger 17 through the backing material to the position shown in FIG. 7. The end of the plunger 17 engages the yarn 83 and forces it a predetermined distance through the backing material 85 to form a loop 87 of the yarn 83.

Next, with the shuttle 15 is held in position to maintain the plunger 17 in the down position of FIG. 7, the handle 21 is pulled upwardly to move the body 13 upwardly to commence withdrawing the penetrating portion 63 from the backing material 85. As the penetrating portion 63 is withdrawn, the second section 77 bears against a contiguous thread 89 of the backing material 85 (FIG. 8). This cooperation between the inclined second section 77 and the thread 89 cams the needle 19 to the left as viewed in FIG. 8. Because the plate 59 of the needle 19 bears against the plunger 17, the plunger 17 is resiliently deformed. Accordingly, when the point 67 is moved upwardly sufficiently to clear the thread 89, the resilient energy stored in the plunger 17 pushes the entire tufting tool 11 to the right to the position shown in FIG. 9. This automatically advances the needle 19 approximately the correct distance to provide the desired five or six stitches per inch. Thus, the "step" taken by the tufting tool 11 is substantially automatic and substantially unaffected by the operator. The body member 13 can then be advanced to the position shown in FIG. 6 and the cycle described hereinabove is repeated.

Each time the penetrating portion 63 is withdrawn from the backing material 85, the needle 19 is automatically advanced or stepped approximately the same amount.

Although an exemplary embodiment of this invention has been shown and described, many changes, modifications and substitutions may be made by those with ordinary skill in the art without necessarily departing from the spirit and scope of this invention.

We claim:

1. A tufting tool comprising:

an elongated body;

a shuttle mounted on said body for reciprocating movement relative to said body;

an elongated resilient plunger attached to said shuttle for movement with said shuttle;

a needle mounted on said body adjacent one end of said body, said needle having a yarn receiving passage and a plunger receiving passage with the plunger receiving passage being adapted to receive at least a portion of the plunger;

said needle including a first portion attached to the body and a penetrating portion projecting from said first portion and terminating in a relatively sharp point remote from said first portion, said yarn receiving passage extending through the first portion and the penetrating portion;

said penetrating portion and said resilient plunger being adapted for insertion and into and withdrawal from a backing material as the body and the plunger are relatively reciprocated; and said penetrating portion including cam means having a throw of at least about 0.020 inch and cooperable with the backing material as the penetrating portion is withdrawn from the backing material with the plunger remaining in the backing material for resiliently loading the plunger so that upon complete withdrawal of the penetrating portion from the backing material the plunger resiliently moves the needle forward relative to the plunger whereby the needle undergoes a controlled advancing movement along the backing material.

2. A tufting tool as defined in claim 1 wherein the throw of said cam means is at least about 0.030 inch.

3. A tufting tool as defined in claim 2 wherein the throw of said cam is no more than about 0.040 inch.

4. A tufting tool as defined in claim 1 wherein the throw of said cam means is no more than about 0.050 inch.

5. A tufting tool as defined in claim 1 wherein said cam means includes an exterior surface region of said penetrating portion.

6. A tufting tool as defined in claim 1 wherein said penetrating portion has a first exterior edge surface radially remote from the body and extending generally in the same direction as said yarn receiving passage and terminating at said point, at least a portion of said first exterior edge surface extending radially away from said body as said first exterior edge surface extends toward said point, said cam means including at least said portion of said first exterior edge surface.

7. A tufting tool as defined in claim 1 wherein said penetrating portion includes relatively straight section and an end section which terminates in said point, said straight section joining said end section to said first portion, said end section being inclined relative to said straight section, and said cam means including said end section.

8. A tufting tool comprising:

an elongated body;

a shuttle mounted on said body for reciprocating movement relative to said body;

an elongated resilient plunger attached to said shuttle for movement with said shuttle;

a needle mounted on said body adjacent one end of said body, said needle having a yarn receiving passage and a plunger receiving passage with the plunger receiving passage being adapted to receive at least a portion of the plunger;

said needle including a first portion attached to the body and a penetrating portion projecting from said first portion and terminating in a relatively sharp point remote from said first portion, said yarn receiving passage extending through the first portion and the penetrating portion;

said penetrating portion having a first exterior edge surface remote from the body, said first exterior edge surface extending generally in the same direction as said yarn receiving passage and terminating at said point; and at least a portion of said first exterior edge surface extending in a direction having a radial component to displace said point radially of the body at least about 0.020 inch from the position the point would occupy if the radial component were zero.

9. A tufting tool as defined in claim 8 wherein said surface exterior edge surface includes first section between said first section and the point and a second section between said first section and the point, said first section being relatively flat in axial cross section and said second section being inclined radially away from said body as it extends toward said point to thereby displace said point radially of the body at least about 0.020 inch.

10. A tufting tool as defined in claim 9 wherein said penetrating portion has a second exterior edge surface radially intermediate the first exterior edge surface and the body, said second exterior edge surface having an inclined section terminating at said point and being inclined in the same direction as said second section.

11. A tufting tool as defined in claim 10 wherein said point is radially displaced at least about 0.030 inch and no more than about 0.040 inch from the position it would occupy if said radial component were zero.

* * * * *